US008820964B2

(12) United States Patent
Gould

(10) Patent No.: US 8,820,964 B2
(45) Date of Patent: Sep. 2, 2014

(54) LINEAR LIGHTING SYSTEM

(75) Inventor: Carl Gould, Golden, CO (US)

(73) Assignee: ABL IP Holding LLC, Conyers, GA (US)

( * ) Notice: Subject to any disclaimer, the term of this patent is extended or adjusted under 35 U.S.C. 154(b) by 422 days.

(21) Appl. No.: 13/196,596

(22) Filed: Aug. 2, 2011

(65) Prior Publication Data

US 2013/0033863 A1 Feb. 7, 2013

(51) Int. Cl.

| | |
|---|---|
| ***F21V 5/04*** | (2006.01) |
| ***F21V 5/00*** | (2006.01) |
| *F21Y 101/02* | (2006.01) |
| *F21Y 103/00* | (2006.01) |

(52) U.S. Cl.

CPC ..... *F21V 5/00* (2013.01); *F21Y 2101/02* (2013.01); *F21Y 2103/003* (2013.01)

USPC ..... 362/245; 362/244; 362/249.02

(58) Field of Classification Search

USPC ..... 362/237, 240, 244, 245, 249.02, 327, 362/335

See application file for complete search history.

(56) References Cited

U.S. PATENT DOCUMENTS

| | | | |
|---|---|---|---|
| 2,807,709 | A | 9/1957 | Guth |
| 3,460,299 | A | 8/1969 | Wilson |
| 3,562,513 | A | 2/1971 | Jaffa |
| 4,186,433 | A | 1/1980 | Baldwin |
| 4,263,639 | A | 4/1981 | Schacht |
| 5,426,574 | A | 6/1995 | Carolfi |
| 5,430,630 | A | 7/1995 | Swarens et al. |
| 5,528,474 | A | 6/1996 | Roney et al. |
| 5,897,201 | A | 4/1999 | Simon |
| 6,843,586 | B1 | 1/2005 | Allaire |
| 7,284,883 | B2 | 10/2007 | Clark et al. |
| 7,311,423 | B2 | 12/2007 | Frecska |
| D597,245 | S | 7/2009 | Trumble et al. |
| D599,948 | S | 9/2009 | Armbruster |
| D600,394 | S | 9/2009 | Armbruster |
| 7,832,907 | B2 | 11/2010 | Kotovsky et al. |
| 2002/0155805 | A1 | 10/2002 | Paschke |
| 2006/0146531 | A1 | 7/2006 | Reo et al. |
| 2007/0053193 | A1 | 3/2007 | Joffre |
| 2007/0139918 | A1 | 6/2007 | Laukhuf |
| 2008/0304250 | A1* | 12/2008 | Harbers et al. ..... 362/84 |
| 2009/0296017 | A1* | 12/2009 | Itoh et al. ..... 349/61 |
| 2010/0110658 | A1 | 5/2010 | Peifer |
| 2010/0195323 | A1 | 8/2010 | Schaefer et al. |
| 2011/0090684 | A1 | 4/2011 | Logan et al. |

* cited by examiner

*Primary Examiner* — Thomas M Sember

(74) *Attorney, Agent, or Firm* — Kilpatrick Townsend & Stockton LLP

(57) ABSTRACT

Embodiments of the invention are directed toward a lighting system that includes a primary optic having a length, a plurality of discrete light sources disposed along an axis, and a ribbed refractor. The ribbed refractor can include a plurality of linear ribs that are arranged substantially perpendicular to the line of discrete light sources. The ribbed refractor can refract light from the plurality of discrete light sources into a continuous line of light as viewed along the length of the primary optic, thereby masking the discrete nature of the light sources. In some embodiments, the ribbed refractor does not substantially alter the photometric distribution of light perpendicular to the axis.

18 Claims, 11 Drawing Sheets

LINEAR LIGHTING SYSTEM

FIELD

Embodiments of the present invention relate to lighting systems that mask the discrete nature of its light sources.

BACKGROUND

Light emitting diode (LED) technology has progressed to the point where it has become viable for general illumination applications. This progression encompasses both the quantity and quality of light output as well as device efficiency and cost effectiveness. LEDs have some desirable properties such as long life and controllability. It is projected that these devices will continue to improve and that costs of LEDs will continue to decrease. But the discrete nature of LEDs (or any other discrete light source) can be problematic with respect to issues of glare and/or shadowing, as well as an undesirable level of visual noise when viewed directly or as a reflected image from a glossy surface.

BRIEF SUMMARY

An optical system is disclosed according to some embodiments of the invention that can include a primary optic having a length, a plurality of discrete light sources disposed in a line along the length of the primary optic, and a ribbed refractor. The ribbed refractor can include a plurality of linear ribs that are arranged substantially perpendicular to the line of discrete light sources. The ribbed refractor can refract light from the plurality of discrete light sources into a continuous line of light as viewed along the length of the primary optic, thereby masking the discrete nature of the light sources.

The following detailed description together with the accompanying drawings will provide a better understanding of the nature and advantages of the present invention.

DETAILED DESCRIPTION

Figure 1A:
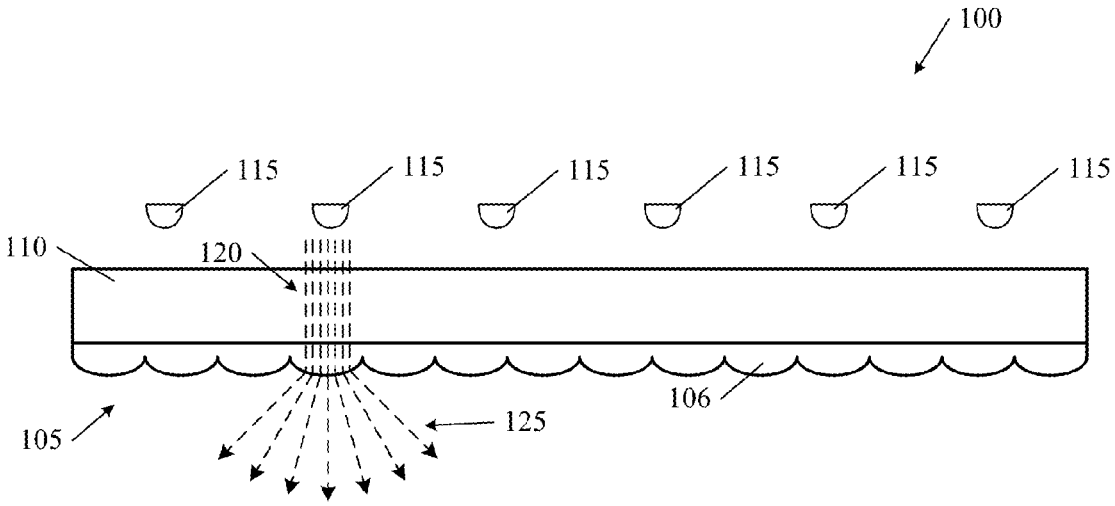
FIG. 1A is a side elevation view of a linear lighting system with a convex ribbed refractor according to some embodiments of the invention.

The following disclosure describes in detail various and alternative embodiments of the invention with accompanying drawings. Numerals within the drawings and mentioned herein represent substantially identical structural elements. Each example is provided by way of explanation, and not as a limitation. Modifications and variations can be made. For instance, features illustrated or described as part of one embodiment may be used on another embodiment to yield a further embodiment. This disclosure includes various modifications and variations.

Embodiments of the invention are directed toward an optical system that, when viewed, produces a continuous line of light from an array of discrete light sources. In some embodiments, the discrete light sources are arranged along a straight line and the resulting line of light is created along a longitudinal axis parallel with the linear array of discrete light sources. A ribbed refractor can be used to disperse the image of the discrete light sources into a continuous, longitudinal line of light. In some embodiments, the ribbed refractor is constructed from a clear ribbed optical element. In some embodiments, the ribbed refractor does not disperse light in a latitudinal direction (a direction perpendicular to the linear array of discrete light sources). Moreover, in some embodiments, the ribbed refractor does not diffuse the light and/or does not provide a translucent or hazy appearance.

The term "disperse" or "dispersion" as used herein means the reflection or refraction of light in a controlled manner. That is, dispersed light is light that is spread in a controlled manner. Dispersed light is not scattered in many directions and is not reflected or refracted randomly.

The terms "diffuse" or "diffusion" as used herein mean the reflection or refraction of light in a random or angularly unconstrained manner. That is, diffused light is light that is scattered in many directions and not directly reflected according to the law of reflection (e.g., where the angle of incidence equals angle of reflection) or directly refracted according to Snell's law of refraction.

The term "translucent" as used herein is a property of a material that describes how light passes through the material in such a way that an image of an object viewed through the material is not well defined. Translucent material allows light to pass through, but it does not preserve a clear or crisp image of an object. Thus light passing through a translucent material is diffused or scattered in transmission resulting in patterns of light that may appear hazy and/or fuzzy to an observer.

Embodiments of the invention provide for an optical system that produces a continuous line of light from a linear array of discrete light sources when viewed. The continuous line of light is perceived by a viewer at a distance from the optical system. For example, a viewer at 8', 10', 12' or more will consider the line of light from the optical system to come from a linear lighting system instead of from a linear array of discrete light sources.

Figure 1B:
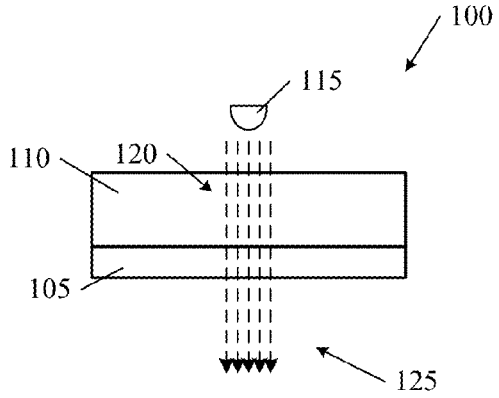
FIGS. 1B and 1C are end views of the linear lighting system of FIG. 1A showing different lateral photometric distributions.

FIG. 1A is a side view and FIG. 1B is an end view of linear lighting system 100 with a linear array of light sources 115, primary optic 110, and ribbed refractor 105 according to some embodiments of the invention. In this embodiment, light sources 115 are positioned along an axis. In this embodiment, the light sources 115 are aligned in a straight line along the axis. In this representative figure, only six light sources 115 are shown, but any number of light sources 115 may be used. Light sources 115 can be discrete point sources of light; for example, LEDs may be used. Light sources 115 may be arrayed in a regular pattern with a fixed distance between each light source. In some embodiments, light sources 115 may be arrayed in a straight line. In other embodiments, light sources may be arrayed in a curved or serpentine line.

Light from light sources 115 is directed toward primary optic 110. Primary optic 110 can be configured to directionally distribute light into an architectural space. In some embodiments, primary optic 110 can be constructed from an optically clear material. That is, primary optic 110 may not diffuse light from light sources 115. In some embodiments, primary optic may also be transparent but not translucent. The size, shape, dimension, optical characteristics, etc. of the primary optic can vary depending on the specific application. In some embodiments, primary optic 110 can optically control light from light sources 115. For example, primary optic 110 can control light in the lateral dimension (e.g., the dimension perpendicular to the line of light sources) as well as the longitudinal direction. But, in some embodiments, ribbed refractor 105 can only control the light longitudinally. Moreover, primary optic 110 can provide a specific photometric distribution in the lateral dimension that is not substantially modified by the ribbed refractor 105.

Ribbed refractor 105 can include a plurality of convex ribs 106. Light 120 can travel through primary optic 110 into ribbed refractor 105. Ribbed refractor 105 is provided below the primary optic 110. Ribbed refractor 105 may be a separate component that is optically coupled to the primary optic 110 (such as with optical adhesive) or alternatively the ribbed refractor 105 (and more specifically the convex ribs 106) may be formed integrally with the primary optic 110. In some embodiments, convex ribs 106 extend laterally in a direction substantially perpendicular to the axis along which the linear array of light sources 115 extends. Ribbed refractor 105 can be designed to control the dispersion of light to produce a line of light when viewed along the longitudinal length of light system 100 (see FIG. 7). As a specific example, primary optic 110 can provide optical control to the light in the longitudinal and/or lateral dimensions, whereas ribbed refractor 105 (or any other ribbed refractor) can control the output of light in the longitudinal dimension only within normal optical limits. Ribbed refractor 105 can also preserve the lateral photometric distribution of light provided by primary optic 110 with negligible optical effects.

Figure 1C:
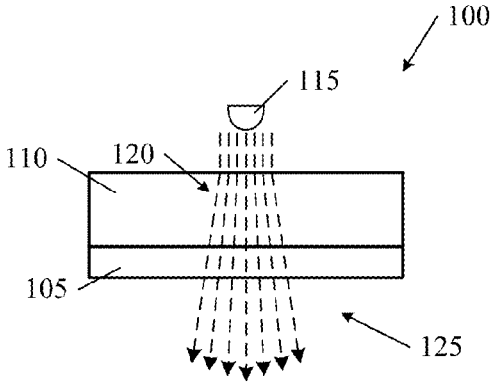

As shown in FIG. 1A, light 125 is dispersed along the longitudinal length of ribbed refractor 105. As shown in FIG. 1B, light 125 is not shaped laterally by ribbed refractor 105. In FIG. 1C, light 120 is shaped latterly by primary optic 110. But light 125 exiting ribbed refractor 105 is not dispersed or altered laterally by ribbed refractor 105. As such, ribbed refractor 105 maintains the photometric distribution of light provided by the primary optic in the lateral direction relative to the axis of the light sources. And ribbed refractor 105 spreads the photometric distribution in the longitudinal direction relative to the axis of light sources.

Ribbed refractor 105 can be manufactured from an optically transparent material (e.g., glass or acrylic) that is not translucent, hazy, or diffuse. Moreover, ribbed refractor 105 can disperse light along the longitudinal length of the ribbed refractor 105 (e.g., parallel with the array of light sources 115) and does not appreciably disperse light laterally (e.g., perpendicular with the array of light sources 115). In some embodiments, ribbed refractor 105 includes an array of linear ribs that are identically shaped and/or identically sized within typical manufacturing tolerances. Ribbed refractor 105 can be molded, embossed, extruded, etc from optically clear material. In some embodiments, ribbed refractor 105 can be coupled with an exit surface of primary optic 110 and/or positioned near the exit surface of primary optic 110. In some embodiments, ribbed refractor can be placed between primary optic 110 and light sources 115 (see FIG. 3).

Figure 2A:
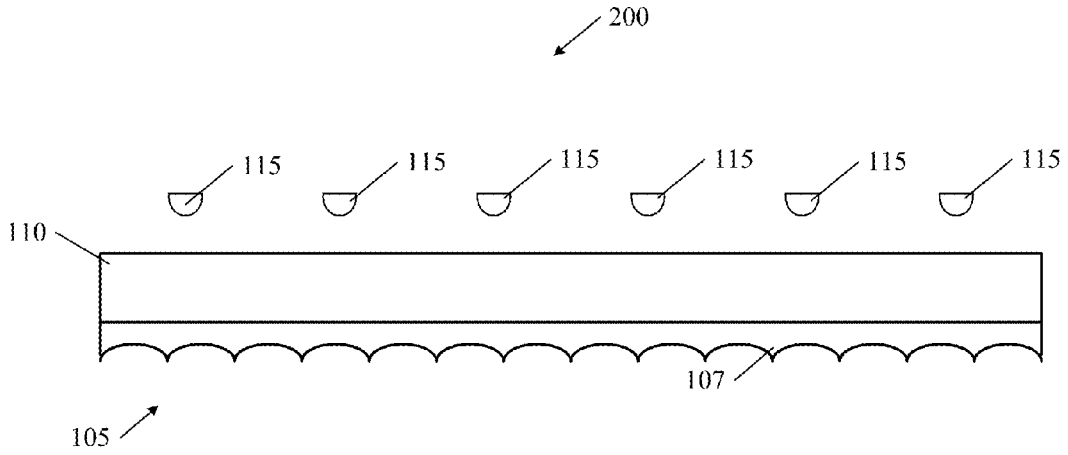
FIG. 2A is a side view of a linear lighting system with a concave ribbed refractor according to some embodiments of the invention.
Figure 2B:
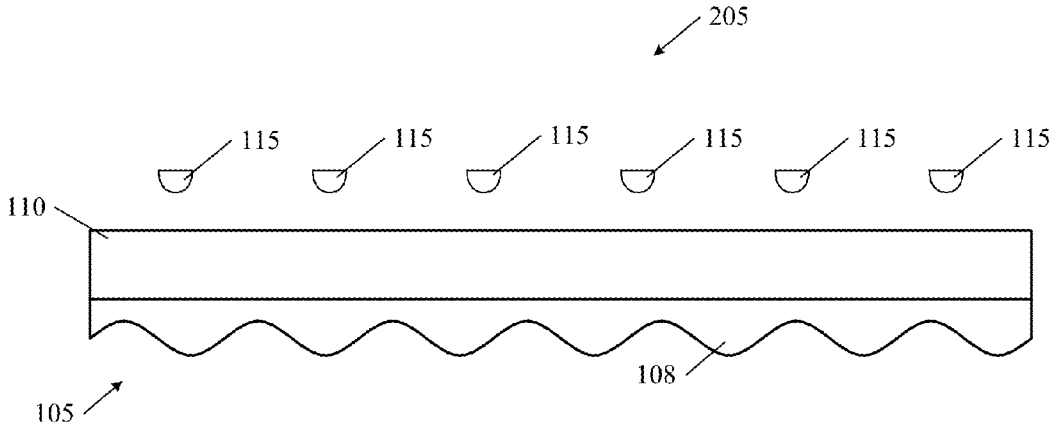
FIG. 2B is a side view of a linear lighting system with a sinusoidal ribbed refractor according to some embodiments of the invention.

Ribbed refractor 105 can be formed with ribs having a number of other shapes. For example, refractor may include a plurality of concave ribs 107 as shown in FIG. 2A or a plurality of sinusoidal ribs 108 as shown in FIG. 2B. Various other geometric rib patterns and/or styles may be used. For example, any combination of concave and/or convex ribs can be used. As another example, a uniform combination of one type of rib, either concave or convex, can be used.

Figure 3:
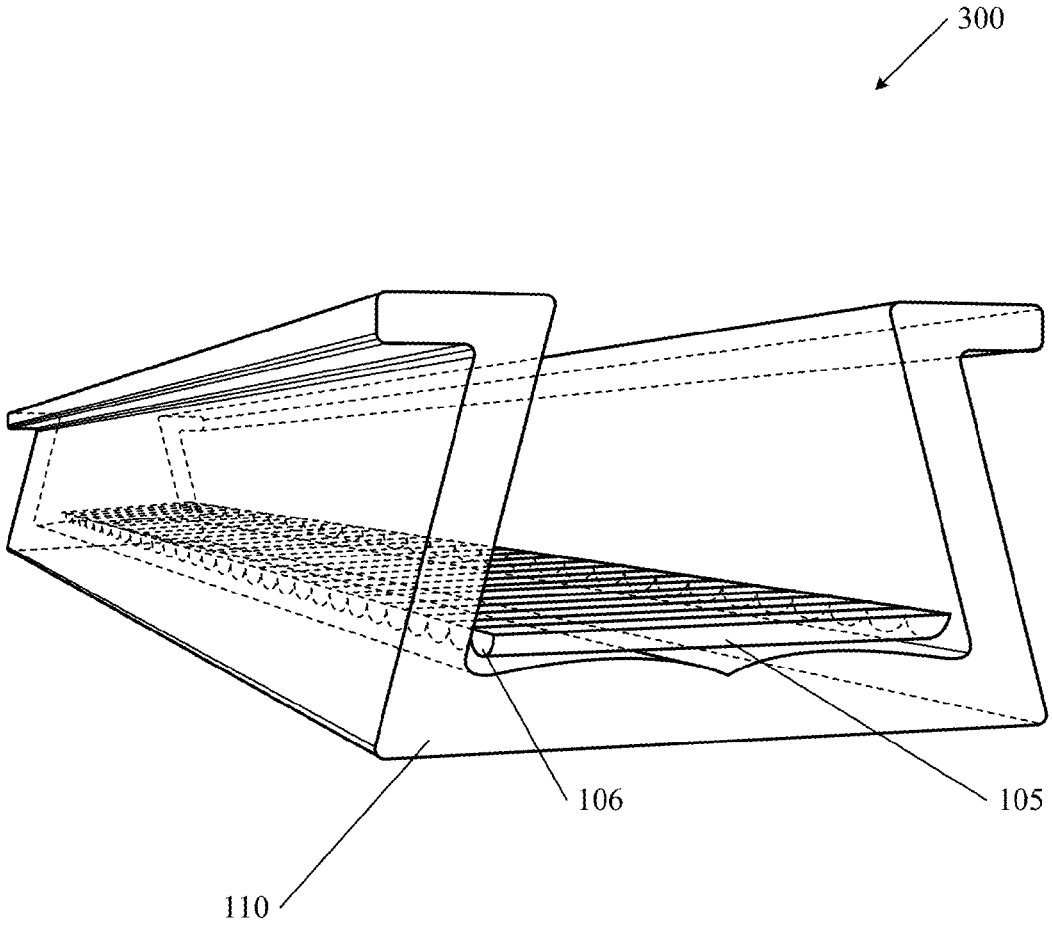
FIG. 3 is a ribbed refractor disposed within a primary optic according to some embodiments of the invention.

FIG. 3 shows light system 300 with ribbed refractor 105 disposed within primary optic 110 such that light passes through ribbed refractor 105 before passing through primary optic 110. In this embodiment, primary optic 110 can be part of a standard lighting system. In particular, primary optic 110 can be a standard lens of a lighting system and can provide optical control to light from light sources (not shown) extending above, and along the length of, the primary optic 110 when in use. Ribbed refractor 105 can be positioned or secured (e.g., glued) within primary optic 110 or convex ribs 106 may be formed integrally in primary optic 110. While primary optic 110 in FIG. 3 has a specific shape, any other primary optic can be used without limitation. Also, while ribbed refractor 105, shown in this embodiment, has convex ribs 106, any other type of refractor with any type of pattern may be used.

Figure 4:
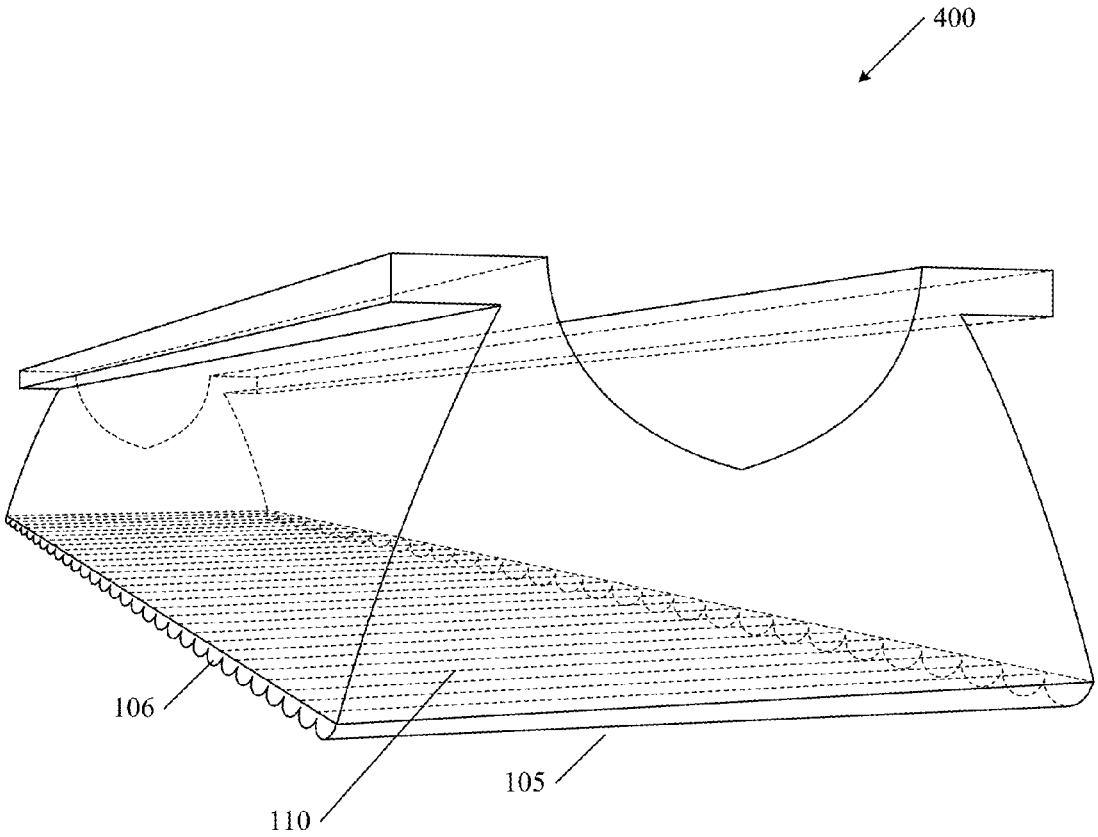
FIG. 4 is a ribbed refractor disposed under a primary optic according to some embodiments of the invention.

FIG. 4 shows light system 400 with ribbed refractor 105 disposed under primary optic 110 such that light from light sources (not shown) extending above, and along the length of, the primary optic 110 passes through ribbed refractor 105 after passing through primary optic 110. Ribbed refractor 105 may be optically bonded (e.g., glued) to the bottom of primary optic 110 or convex ribs 106 may be formed integrally in primary optic 110. Primary optic 110 can be part of any standard lighting system and may have any shape, size, or dimension. In particular, primary optic 110 can be a standard lens of a lighting system. Also, while ribbed refractor 105, in this embodiment, includes a plurality of convex ribs 106, any other type of refractor may be used.

Figure 5:
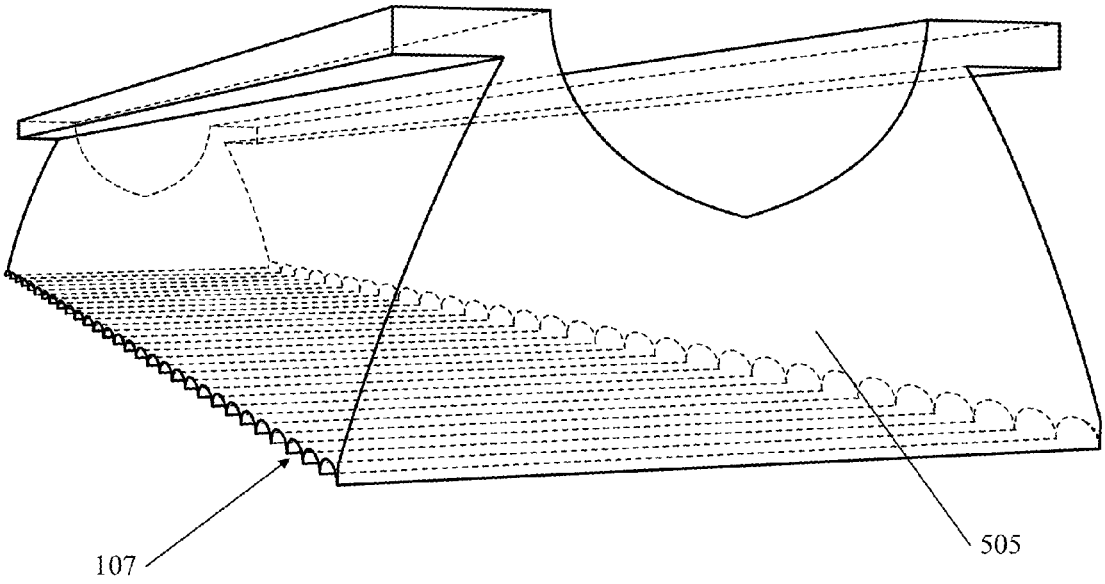
FIG. 5 is a ribbed refractor integral with a primary optic according to some embodiments of the invention.

FIG. 5 shows light system 500 with concave ribs 107 manufactured into primary optic 505 according to some embodiments of the invention. Concave ribs 107 can be machined, extruded, molded, and/or manufactured into the surface of primary optic 505. In this embodiment, primary optic 505 provides the combined functionality of ribbed refractor 105 and the primary optic. Again, however, the concave ribs 107 may be provided on a separate ribbed refractor 105 that is subsequently optically bonded to the primary optic 505.

Figure 6:
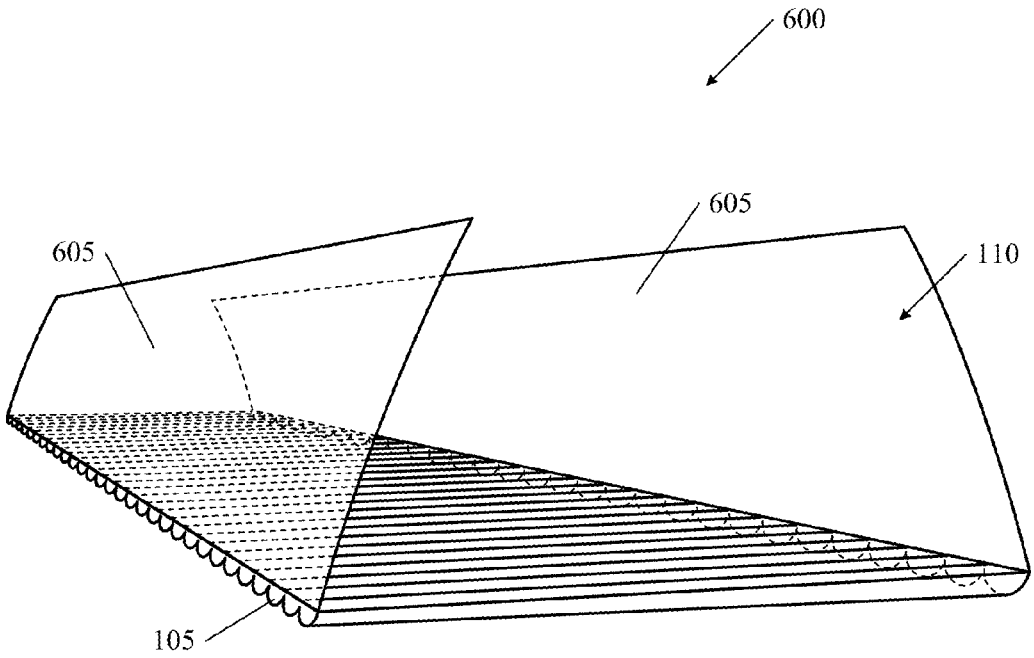
FIG. 6 is a ribbed refractor coupled with a reflective primary optic according to some embodiments of the invention.

FIG. 6 shows light system 600 with a primary optic 610 formed by two optically reflective side walls 605. A ribbed refractor 105 is positioned between the two walls. Light sources can be disposed within or above the primary optic 610. Light from these light sources may be reflected off side walls 605 prior to exiting through ribbed refractor 105. While ribbed refractor 105 shown in this embodiment includes convex ribs 106, any other type of ribbed refractor may be used.

Various other configurations, dimensions, sizes, etc of a reflective primary optic can be used.

Figure 7A:
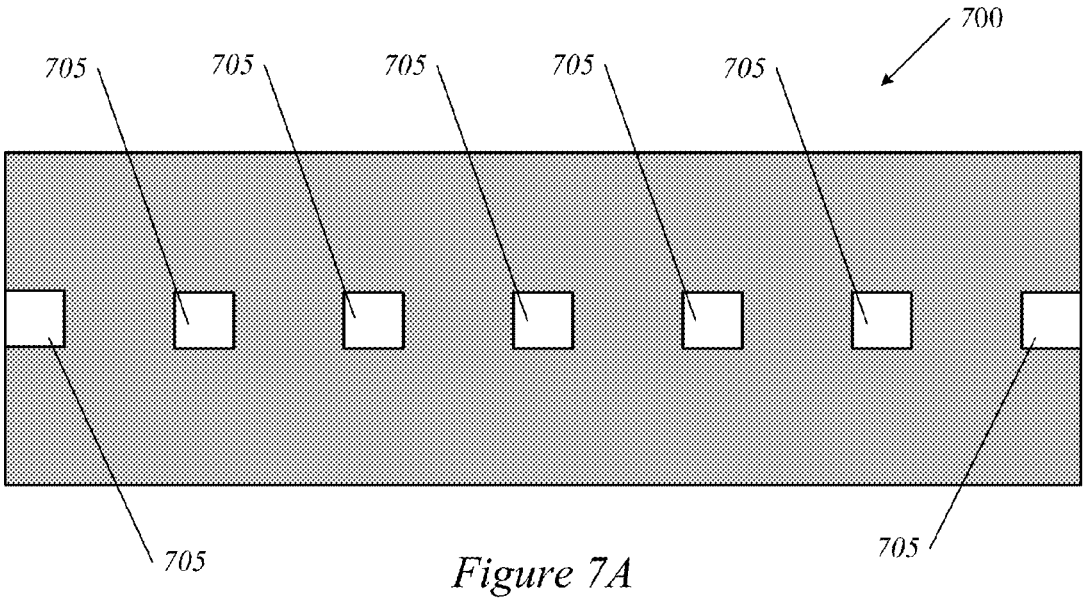
FIG. 7A shows the light response from an array of discrete light sources as seen through a primary optic without a ribbed refractor.

FIG. 7A shows luminous characteristic 700 of an array of discrete light sources as seen through a primary optic without a ribbed refractor. As shown, the discrete light sources produce an array of discrete bright spots 705. This luminous characteristic 700 can be produced from any of the embodiments discussed herein without a ribbed refractor (e.g., ribbed refractor 105 described above). The light sources produce discrete bright spots 705 that are arrayed along the length of the system. The brightness and size of bright spots 705 can depend on the nature of the discreet light source, the distance between viewer and the lighting system, as well as the type and configuration of the primary optic, if any.

Figure 7B:
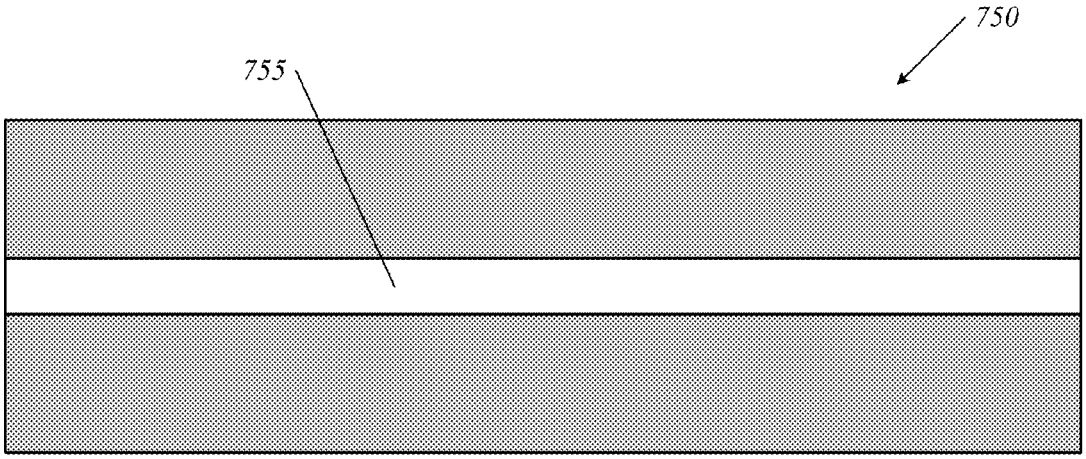
FIG. 7B shows the continuous light response from an array of discrete light sources as seen through a primary optic with a ribbed refractor.

FIG. 7B shows the luminous characteristic 750 of an array of discrete light sources as seen through a primary optic with a ribbed refractor according to some embodiments of the invention. Bright band 755 is a single, linear bright band that extends the length of the system. Thus, embodiments of the invention can blend the optical view of a plurality of discrete light sources from the plurality of discrete bright spots 705 shown in FIG. 7A to the single linear bright band 755 shown in FIG. 7B. It should be noted that the linear bright band 755 can have a uniform width and its width can be substantially the same as the width of each of the plurality of bright spots 705 shown in FIG. 7A. In some embodiments, the width of the linear bright band 755 can be controlled by the primary optic.

The refractive blending of light from the array of discrete sources can reduce the potential for glare by effectively spreading the pixilated luminance of the individual light sources over a larger area. This can be very beneficial since the untreated luminance of individual light sources might be quite high and prone to glare especially for interior applications. Moreover, embodiments of the invention can reduce the potential for reflected glare and/or annoying veiling reflections when an image of the luminous optic is reflected in a glossy surface.

In some embodiments, of the invention a uniformly luminous appearance over the whole linear aperture of the optical system may not occur. Rather, as shown in FIGS. 7A and 7B, embodiments of the invention spread and/or blend the appearance of the primary optic only along the axis of that system. In some embodiments, the luminosity of the discrete light sources is not spread across the lateral dimension (e.g., perpendicular to the axis of the light sources and/or aligned with the direction in which the individual ribs of the ribbed refractor extend), but rather is only be blurred along the length of the line of light sources In some embodiments, the edges of the line of light can remain crisply defined. This linear line of light not only produces a different appearance than diffusion methods, but also preserves the lateral photometric distribution of the primary optic.

Embodiments of the invention can be used to create an efficient and highly controlled linear-only (e.g., not lateral) dispersion of light. Such dispersion may not impart the potentially undesirable hazy appearance associated with holographic and other microscopic-scale diffusers.

In an unlit state, this hazy characteristic conveys a notably less clean and less sophisticated appearance for an optical system. In a lit state, haze in the perpendicular dimension implies compromise to any photometric definition that the primary optic attempts to produce in the perpendicular plane. Additionally, undesirable diffusion in the perpendicular dimension results in a less crisp and/or more glare-prone appearance due to lack of visual definition.

In some embodiments of the invention, the ribbed, refractive geometry can differentially soften and/or attenuate the photometric distribution of a primary optic as a function of the emitted light's orientation with respect to the axis of that system. This can produce very little effect on the angular distribution of light that is substantially perpendicular to that axis, for example the angular distribution provided by the primary optic, while having an increasingly strong attenuation and softening effect as emitted light becomes substantially more parallel to the axis.

Figure 8A:
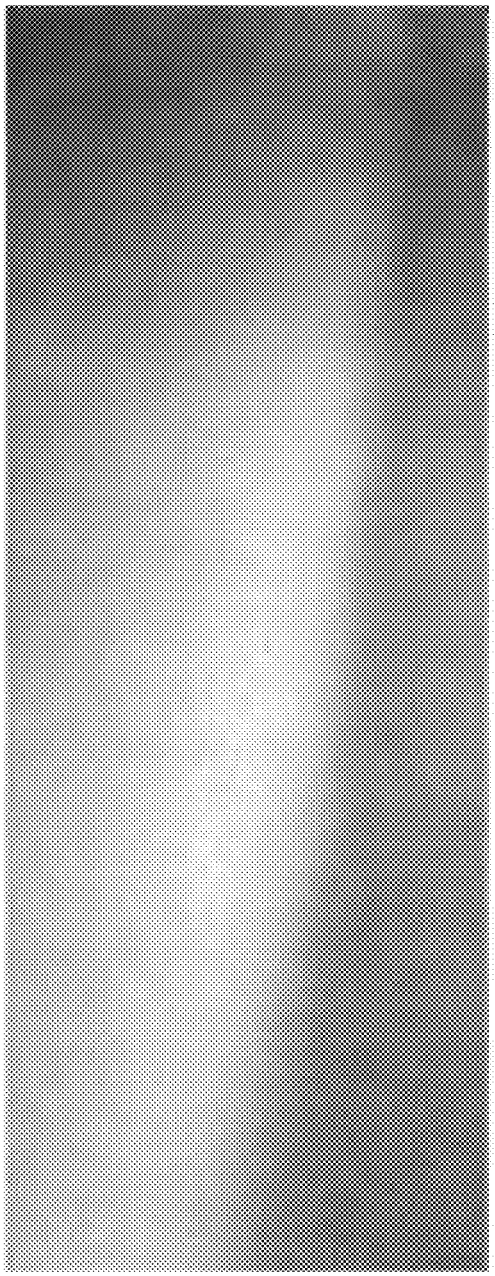
FIG. 8A and FIG. 8B show the differential softening effect that can occur using some embodiments of the invention.
Figure 8B:
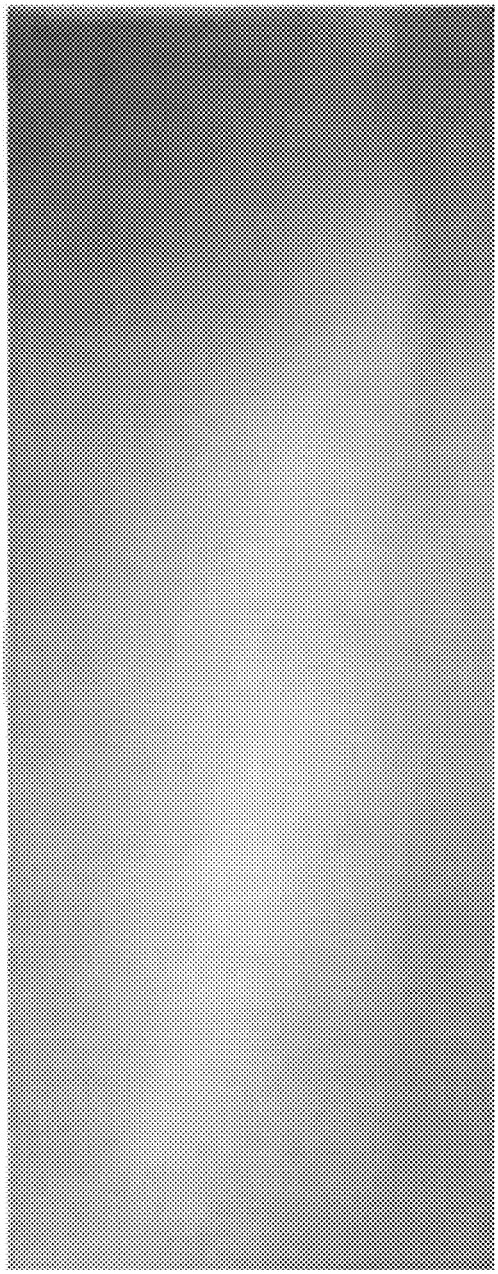

This differential softening effect that can occur in some embodiments of the invention is shown in FIG. 8A and FIG. 8B. In FIG. 8A, the differential softening effect is shown with respect to the unintentional projection of a wall-washing beam onto a nearby perpendicular wall without a ribbed refractor. As shown in FIG. 8B, using a ribbed refractor can improve the pattern on the nearby perpendicular wall, while not substantially affecting the designed illumination pattern on the wall being purposefully washed with light. This same effect can apply to an aisle-lighting application where embodiments of the invention can diminish the potential for peripheral glare and visual distraction to an occupant moving past in a cross aisle.

Figure 9C:
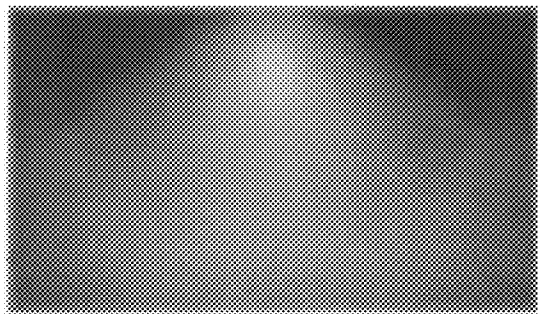
FIGS. 9A, 9B and 9C show the effects on wall illumination using the embodiments of the invention.
Figure 9B:
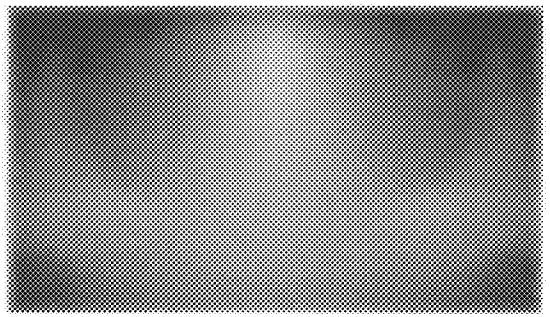
Figure 9A:
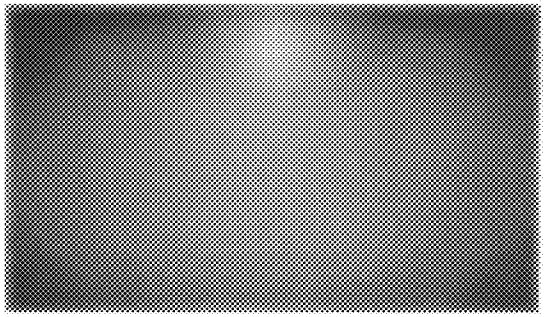

FIGS. 9A, 9B and 9C show how embodiments of the invention can affect wall illumination. FIG. 9A shows a substantially uniform light pattern from a single LED with a reflective linear primary optic. FIG. 9B shows a non uniform light pattern using a single LED and a standard refractive linear lens (e.g., not an embodiment of the invention described herein and/or not using a ribbed refractor as described herein). This non uniformity is due to the differing behavior of three dimensional refraction as opposed to three dimensional reflection in a linearly extruded geometry. FIG. 9C shows wall illumination from a single LED with a standard refractive primary optic and a ribbed refractor according to embodiments of the invention. In FIG. 9C the resulting light pattern is softer and more continuous than the pattern shown in FIG. 9B. The resulting light pattern is more similar to the desired light pattern shown in FIG. 9A.

Figure 10C:
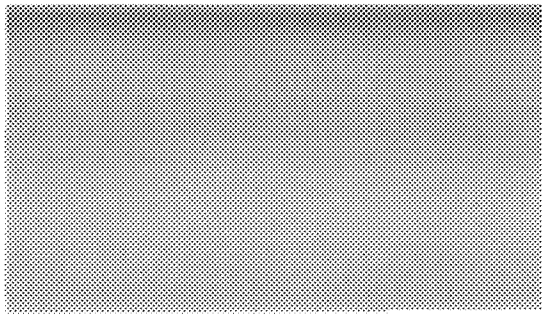
FIGS. 10A, 10B and 10C show the effects on wall illumination using embodiments of the invention.
Figure 10B:
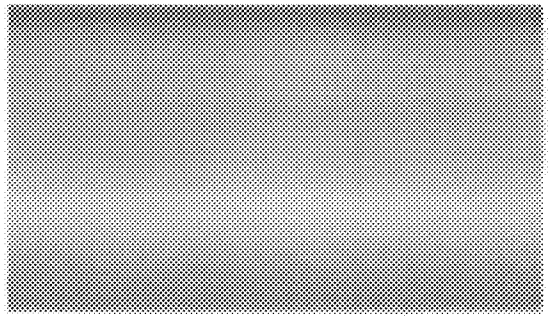
Figure 10A:
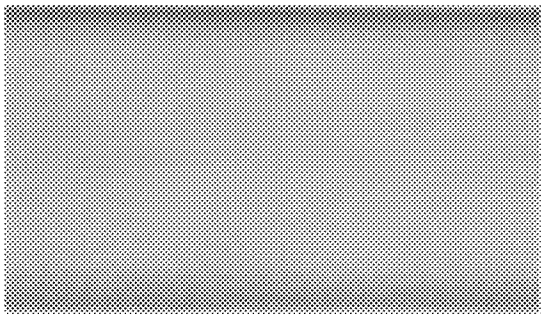

FIGS. 10A, 10B and 10C show how embodiments of the invention can affect wall illumination. FIG. 10A shows a substantially uniform light pattern from a linear array of LEDs with a linear reflective primary optic. FIG. 10B shows a non uniform light pattern using a linear array of LEDs and a standard refractive linear lens (e.g., not an embodiment of the invention described herein and/or not using a ribbed refractor as described herein). This non uniformity is due to the differing behavior of three dimensional refraction as opposed to three dimensional reflection in a linearly extruded geometry. FIG. 10C shows wall illumination from a linear array of LEDs with a standard refractive primary optic and a ribbed refractor according to embodiments of the invention. In FIG. 10C the resulting light pattern is softer and more continuous than the pattern shown in FIG. 10B. The resulting light pattern is more similar to the desired light pattern shown in FIG. 10A.

Figure 11:
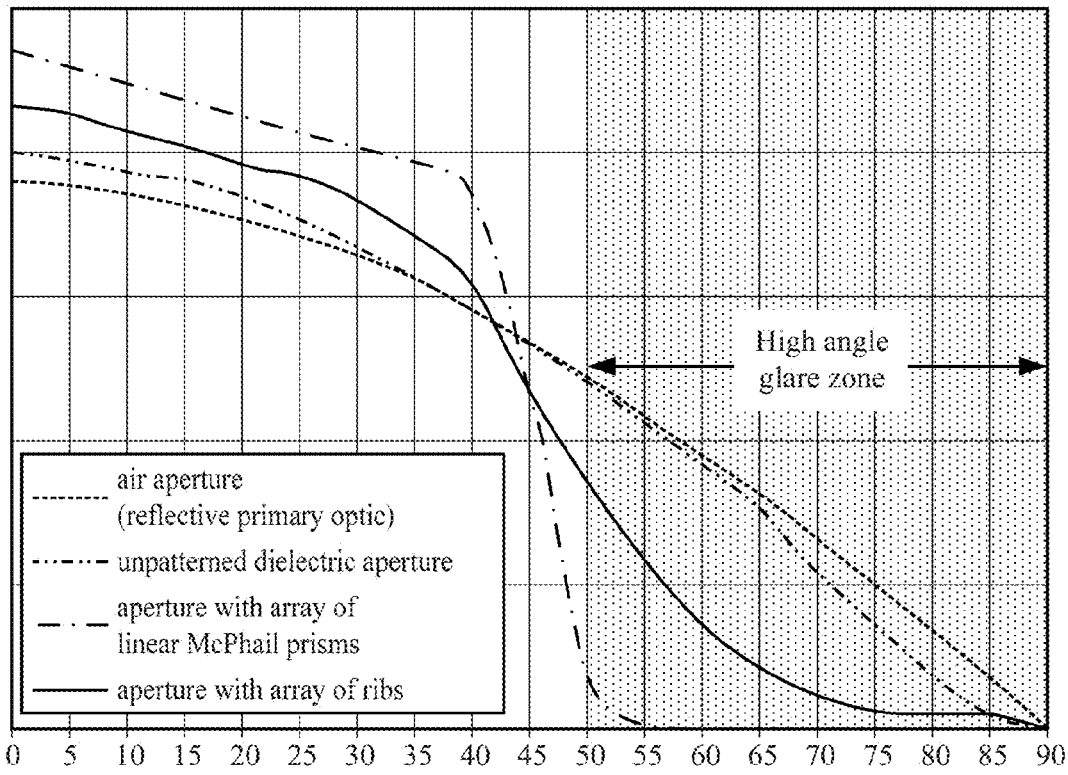
FIG. 11 is a graph showing light attenuation in the photometric plane parallel to the axis of the primary optic using embodiments of the invention.

FIG. 11 is a graph showing light attenuation in the photometric plane parallel to the axis of the primary optic using embodiments of the invention. As shown in the graph, embodiments of the invention provide lighting response with low high-angle glare in comparison with other systems. This low glare can be evident along an axis parallel with a line along which the light sources are disposed. Moreover, the response (or the slope of the curve) using an array of ribs is less steep than the response using McPhail prisms. Having a less steep response softens the visual perception of the fixture as a viewer moves from a position viewing the fixture at a high angle to a position viewing the fixture at a low angle and vice-versa. The steep curve shown with McPhail prisms would cause an abrupt change in the viewed light as a viewer transitions from high angle to a low angle and vice-versa.

Thus, although the invention has been described with respect to specific embodiments, it will be appreciated that the invention is intended to cover all modifications and equivalents within the scope of the following claims. The present disclosure has been presented for purposes of example rather than limitation, and does not preclude inclusion of such modifications, variations and/or additions to the present subject matter as would be readily apparent to one of ordinary skill in the art.

What is claimed is:

1. A light fixture comprising:

a plurality of LEDs spaced along an axis, adjacent ones of the LEDs being spaced at a first distance from one another;

a ribbed optical element configured to receive and disperse the light from the plurality of LEDs into a continuous line of light parallel to the axis, without substantially altering a photometric distribution of the light in a direction perpendicular to the axis, the ribbed optical element comprising an optically clear material with a plurality of ribs disposed on a surface thereof and extending perpendicular to the axis;

adjacent ones of the ribs being disposed on the surface at a pitch that is less than the first distance.

2. The light fixture according to claim 1, wherein adjacent ones of the LEDs are aligned differently with respect to ones of the ribs that are nearest to each of the adjacent ones of the LEDs.

3. The light fixture according to claim 1, wherein the plurality of ribs comprise a plurality of convex ribs that are identically shaped and oriented.

4. The light fixture according to claim 1, wherein the plurality of ribs are uniform.

5. The light fixture according to claim 1, further comprising a linear optic disposed between the plurality of LEDs and the ribbed optical element.

6. A light fixture comprising:

a plurality of LEDs spaced along an axis, adjacent ones of the LEDs being spaced at a first distance from one another;

a ribbed optical element configured to receive and disperse the light from the plurality of LEDs into a continuous line of light parallel to the axis, without substantially altering a photometric distribution of the light in a direction perpendicular to the axis, the ribbed optical element comprising an optically clear material with a plurality of ribs disposed on a surface thereof and extending perpendicular to the axis;

adjacent ones of the ribs being disposed on the surface at a pitch that is less than the first distance; and a linear optic, wherein the ribbed optical element is disposed between the plurality of LEDs and the linear optic.

7. An optical system comprising:

a primary optic, comprising an optically clear material and having a length;

a plurality of discrete light sources disposed along an axis parallel to the length of the primary optic, adjacent ones of the discrete light sources being spaced at a first distance from one another; and a ribbed optical element comprising a plurality of ribs that extend perpendicular to the axis of the light sources, adjacent ones of the ribs being formed in the ribbed optical element at a pitch that is less than the first distance; wherein the ribbed optical element refracts light from the plurality of discrete light sources into a continuous line of light as viewed along the length of the primary optic without substantially diffusing the light in a direction perpendicular to the axis of the light sources.

8. The optical system according to claim 7, wherein the ribbed optical element comprises a transparent material.

9. The optical system according to claim 7, wherein the ribbed optical element comprises a non-translucent material.

10. The optical system according to claim 7, wherein the plurality of ribs comprise a plurality of convex ribs molded into a surface of the primary optic.

11. The optical system according to claim 7, wherein the ribbed optical element comprises a non-diffuse material.

12. The optical system according to claim 7, wherein the ribbed optical element is formed integrally with the primary optic.

13. The optical system according to claim 7, wherein the primary optic comprises a reflector.

14. The optical system according to claim 7, wherein the plurality of discrete light sources comprises a plurality of LEDs.

15. The optical system according to claim 7, wherein the ribbed optical element is coupled to an exterior surface of the primary optic.

16. The optical system according to claim 7, wherein the primary optic is solid.

17. The optical system according to claim 7, wherein the plurality of ribs comprise a plurality of convex ribs, a plurality of concave ribs, or a plurality of sinusoidal ribs.

18. An optical system comprising:

a primary optic having a length;

a plurality of discrete light sources disposed along an axis parallel to the length of the primary optic, adjacent ones of the discrete light sources being spaced at a first distance from one another; and a ribbed optical element, disposed between the plurality of discrete light sources and the primary optic, and comprising a plurality of ribs that extend perpendicular to the axis of the light sources, adjacent ones of the ribs being formed in the ribbed optical element at a pitch that is less than the first distance; wherein the ribbed optical element refracts light from the plurality of discrete light sources into a continuous line of light as viewed along the length of the primary optic without substantially diffusing the light in a direction perpendicular to the axis of the light sources.

* * * * *